United States Patent [19]

Rush

[11] 4,222,702

[45] Sep. 16, 1980

[54] DECELERATION SENSITIVE AIR TOOL SHUTOFF

[75] Inventor: Earl E. Rush, Mentor, Ohio

[73] Assignee: Cooper Industries, Inc., Houston, Tex.

[21] Appl. No.: 945,607

[22] Filed: Sep. 25, 1978

[51] Int. Cl.[3] ..... F01D 25/06

[52] U.S. Cl. ..... 415/25; 415/36; 73/511; 173/12

[58] Field of Search ..... 173/12; 415/25, 36, 415/42; 73/511, 512; 91/458

[56] References Cited

U.S. PATENT DOCUMENTS

| | | | |
|---|---|---|---|
| 2,376,844 | 5/1945 | Ziebolz | 73/512 |
| 3,791,458 | 2/1974 | Wallace | 173/12 |
| 3,904,305 | 9/1975 | Boyd | 415/25 |
| 4,004,859 | 1/1977 | Borries | 415/25 |
| 4,120,604 | 10/1978 | Garofalo | 173/12 |

FOREIGN PATENT DOCUMENTS

| | | | |
|---|---|---|---|
| 3052 | of 1866 | United Kingdom | 73/511 |

*Primary Examiner*—Louis J. Casaregola
*Attorney, Agent, or Firm*—Wilson, Fraser, Barker & Clemens

[57] ABSTRACT

A shutoff mechanism for a pneumatic tool such as a nut runner senses both the instantaneous speed and the instantaneous rate of change of speed of the drive components of the tool. The mechanism controls the flow of air to the motor and terminates such flow as the drive speed decreases while approaching a stall condition. The mechanism comprises a main air valve operated by a centrifugal governor having a plurality of pivoted weights with their pivot axes oriented at acute angles to radial lines intersecting the centers of the weights rather than oriented at right angles to such radial lines as in conventional governor assemblies. So oriented, the weights sense both instantaneous speed and instantaneous rate of change of speed of the drive components. By sensing these two operating parameters, the shutoff mechanism, in effect, anticipates the stall condition of the drive, terminates air flow thereto more rapidly and accurately than conventional shutoff devices and provides improved consistency of torque application.

10 Claims, 9 Drawing Figures

FIG. 4
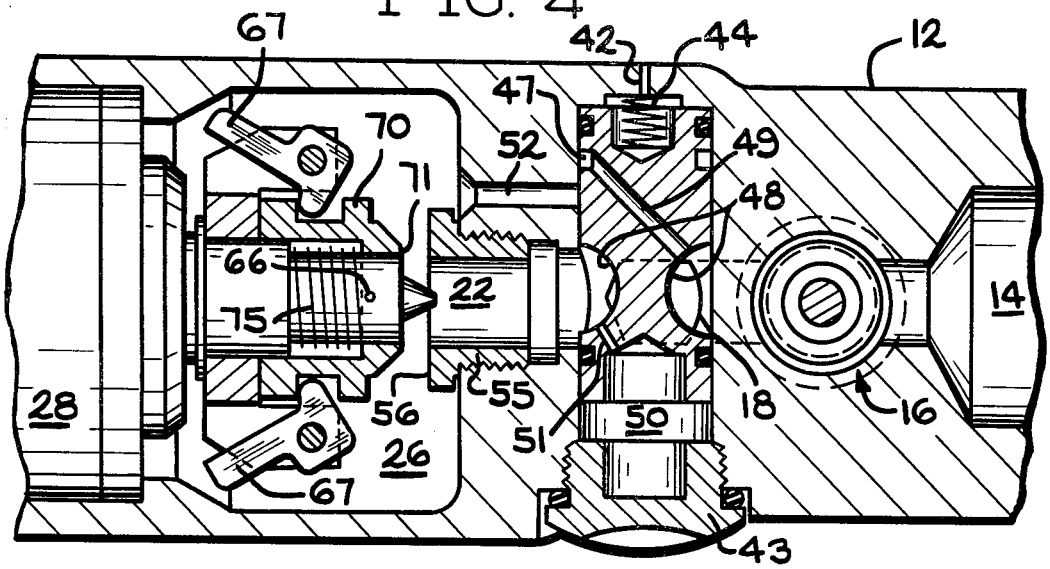
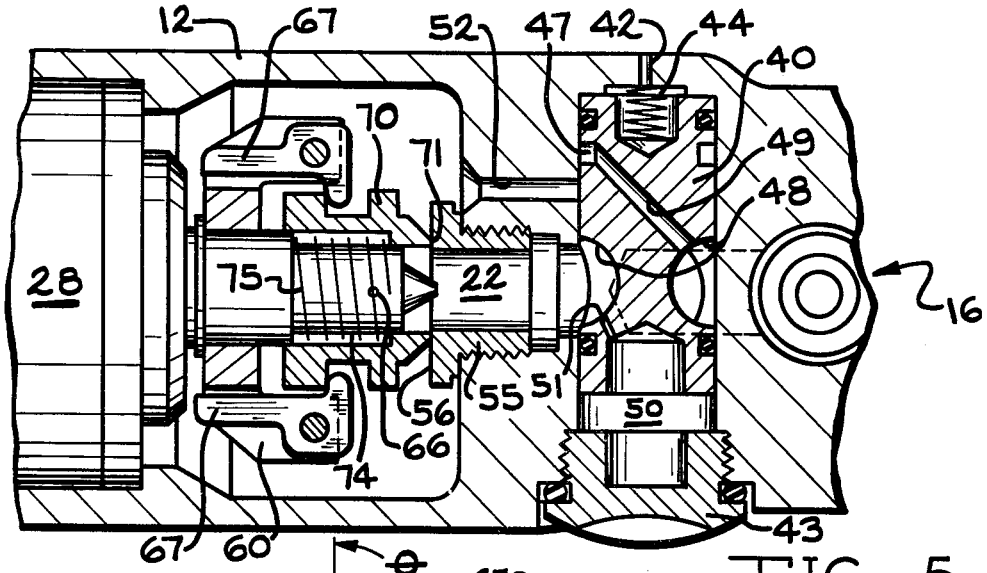
FIG. 5
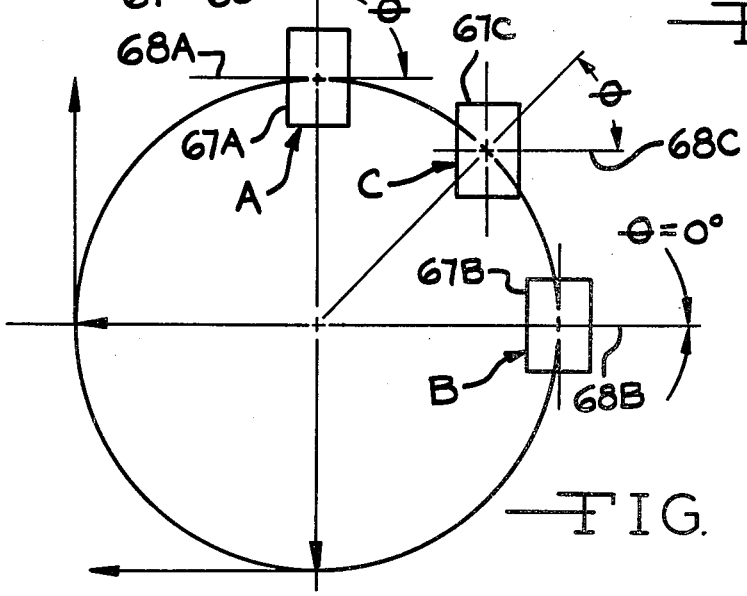
FIG. 6

DECELERATION SENSITIVE AIR TOOL SHUTOFF

BACKGROUND OF THE INVENTION

The invention relates to a speed governor mechanism for use in a pneumatically powered tool and more specifically to a governor mechanism which senses the rate of change of speed as well as the speed of the motor in the pneumatic tool and controls air flow to the motor of the tool in response to these parameters.

Many prior art tools incorporating rotary air powered vane motors also incorporate means to control the maximum delivered torque by terminating the flow of air to the motor as it slows and begins to stall due to the tightening of a fastener or the completion of a similar production step. One such mechanism comprehends the use of a back pressure sensor which automatically shuts off the flow of air to the air motor as the back pressure and torque resistance increase. Tools which incorporate such a pressure sensing system are disclosed in U.S. Pat. Nos. 3,373,824 and 3,608,647. While satisfactory in many applications, this pressure sensitive mechanism has a disadvantage in that it is sensitive to line pressure variations. That is, a pressure surge in the line can prematurely stop the tool, thereby improperly performing the production step. A more serious problem, however, occurs when line pressure is too low to activate the shutoff. This condition can easily result from excessive air consumption, inadequate air supply or partially blocked air lines. As a result, the tool simply fails to shut off. Consequently, the production step may, again, be improperly performed; but of greater concern is the safety of the operator. If the tool is of the high torque output variety, the operator may be subjected to an unexpected and dangerous stall jerk from the tool.

Other prior art tools have used mechanical means such as clutches or ratchet-type devices to control the torque delivered to a fastener or a joint. Such devices are often complex and with regard to the ratchet-type devices are especially subject to wear and concommitant loss of calibration. Devices of this type also waste energy inasmuch as they generally do not remove power from the driving motor but rather merely disconnect the motor from the driving element. Furthermore, it should be noted that these devices will produce a stall jerk if a pressure drop of sufficient magnitude to reduce motor torque below the clutch setting is encountered.

A third class of shutoff control devices encompasses speed control mechanisms. These mechanisms are basically centrifugal governor assemblies which terminate the flow of air to the air motor when the R.P.M. drops below a fixed value. Since these stall control mechanisms sense the slowing of the motor associated with the increase in torque due to the tightening of a fastener or the completion of a production step, they provide more accurate control of the torque output of the tool and minimize improperly completed production steps. Since they are generally insensitive to variations in air line pressure and their mechanism are relatively free from wear, they also retain their accuracy and repeatability. Such devices are disclosed in U.S. Pat. Nos. 3,791,458 and 3,904,305.

These patented shutoff mechanism represent substantial improvements over previous designs. However, torque limiting and shutoff performance of these tools in one particular application has been found to somewhat unsatisfactory. This particular application comprehends those manufacturing steps wherein torque requirements may remain at a very low level throughout most of the operating cycle but increase substantially and rapidly to a higher value as the step is completed. Such a torque-time characteristic is associated with the fastening of two or more relatively unyieldable members by a threaded fastener. During the rundown of the fastener, the torque requirement is minimal and the motor operates near its unloaded speed. As the fastener grounds against the members, the torque requirement increases rapidly to a maximum while the drive motor slows rapidly and stops. Such an application is in contradistinction to the fastening of two structures, one or both of which are yieldable, and which slowly compress and exhibit a gradually incrasing torque requirement and a time-torque parameter. In applications where the torque requirement rises rapidly, it has been found that fasteners are both erraticly tightened and often overtightened. Operator fatigue is also greatly increased due to the generally increased stall jerk which is transmitted thereto.

One cause of such unsatisfactory performance is the momentum of the rotating drive components of the pneumatic tool. That is, although the centrifugal speed governor may terminate, the air flow to the air motor and speed reducing components will be transferred to and absorbed by the fastener and it will generally be overtorqued. Stated in another manner, the torque increase and stall occurs so rapidly that the speed control governor is incapable of terminating the air flow to the motor either as rapidly or as uniformly as is required to uniformly tighten a fastener or complete a manufacturing step.

A second cause of such unsatisfactory performance is the result of the vane type air motor commonly used as a source of power in such tools. At low r.p.m., such motors tend to pulse as the vanes rotate past inlet and exhaust ports. A pulse at a crucial moment of the final torguing of a fastener may also result in an improperly completed manufacturing step.

SUMMARY OF THE INVENTION

The present invention comprises a speed responsive pneumatic tool shutoff which is sensitive to both the instantaneous speed and the instantaneous rate of change thereof.

At the outset, it should be understood that a mass revolving at a fixed distance about an axis is subjected to two accelerative components which act upon it and produce forces: radial acceleration ($R\omega^2$), associated with angular velocity (i.e., the instantaneous speed), which produces a force directed along lines of radius and tangential acceleration ($R\alpha$), associated with a change of speed, which produces a force directed along lines of tangency. The radial acceleration associated force is commonly known as centrifugal force.

In conventional governor assemblies, the flyweights are pivoted about axes tangential to the axis of rotation of the governor assembly such that their centers of gravity move in radial planes and produce forces directed along radial lines. So mounted, the flyweights respond only to radial acceleration and sense only the speed of the rotating component to which the governor is attached. The instant invention comprehends the repositioning of such weights and pivots such that the pivot axes form acute angles with radial (or tangential) lines. So positioned, the flyweights are sensitive not only to radial acceleration but also to tangential acceleration and therefore sense both the rotational speed and the rate of change of speed of the device to which they are attached.

A pneumatic tool incorporating the instant invention generally comprises a control valve, a shuttle valve, the governor controlled shutoff valve and an air motor all enclosed within a generally cylindrical housing. Pressurized air is supplied to the tool and flows through the components of the tool in the order just stated. The control valve is provided with an actuation means positioned externally to the housing and functions in a conventional manner to selectively supply pressurized air to the other components. Since, as has been previously explained, the governor controlled shutoff valve closes at slow speeds and stall conditions of the air motor, means must be provided to momentarily bypass it in order to supply air to the drive motor and cause it to rotate. This means is the shuttle valve. Basically, it is a self-closing bypass valve which is open to allow air to the motor at startup but which closes automatically as the speed of the motor increases and air flow through the shutoff valve is established.

The governor controlled shutoff valve opens in response to the instantaneous rotational speed and acceleration of the governor assembly and closes in response to the instantaneous rotational speed and deceleration of the governor assembly. A conventional governor assembly, as noted, is responsive only to its instantaneous rotational speed. The sensitivity not only to speed but also to acceleration is achieved by orienting the pivot axes of the flyweights at an acute angle relative to lines of radius rather than at a right angle, as in a conventional governor assembly. By extrapolation, it should be clear that by offsetting such flyweights from their conventional perpendicular position through an angle of 90° wherein the axes of pivot of the flyweights coincide with lines of radius, the flyweights will be sensitive solely to tangential acceleration which is representative of the rate of change of speed of the governor assembly. Clearly then, the angle between the axes of pivot of the flyweights and lines of radius may be chosen in the range of from 90° to 0° with a corresponding proportional summation of sensitivities to both radial and tangential acceleration. This geometry and the variable sensitivity to both radial and tangential acceleration will be explained in greater detail in the specification.

The combined sensitivity of the governor controlled shutoff valve to both the speed of the motor and the rate of change of the speed of the motor anticipates the imminent stall of the motor and terminates the supply of air thereto. By sensing not only the instantaneous decreasing speed but also the rate at which the speed is decreasing, more accurate control of the air supply to the drive motor and thus the torque delivered by the pneumatic tool to a fastener is achieved. In fastener applications where the transition between the low torque requirement of run down and the high torque requirement of tightening the fastener is abrupt, such anticipation significantly improves the accuracy and repeatability of torque applied to the fastener.

It is thus an object of the instant invention to provide a speed and acceleration sensitive governor which significantly improves the repeatability and accuracy of delivered tightening torque by an air tool.

It is a further object of the instant invention to provide a speed and acceleration sensitive shutoff governor mechanism which confers the benefits of insensitivity to delivered air pressure of conventional speed responsive shutoffs.

It is a still further object of the instant invention to provide a speed and acceleration sensitive pneumatic tool shutoff which minimizes inaccurate low r.p.m. torque delivery caused by vane motor pulsing.

It is a still further object of the instant invention to provide a speed and acceleration sensitive air shutoff for a pneumatic tool which is both simple to manufacture and which will also maintain its calibration due to the insignificant fatigue and wearing of its component parts.

BRIEF DESCRIPTION OF THE DRAWINGS

FIG. 4 is a fragmentary, sectional, top plan view of an air powered tool incorporating the instant invention during steady-state operation;

FIG. 5 is a fragmentary, sectional, top plan view of an air powered tool according to the instant invention during the shutdown sequence;

FIG. 6 is a schematic diagram illustrating the sensitivity of counterweights to axial and tangential acceleration;

DETAILED DESCRIPTION OF THE DRAWINGS

Figure 1:
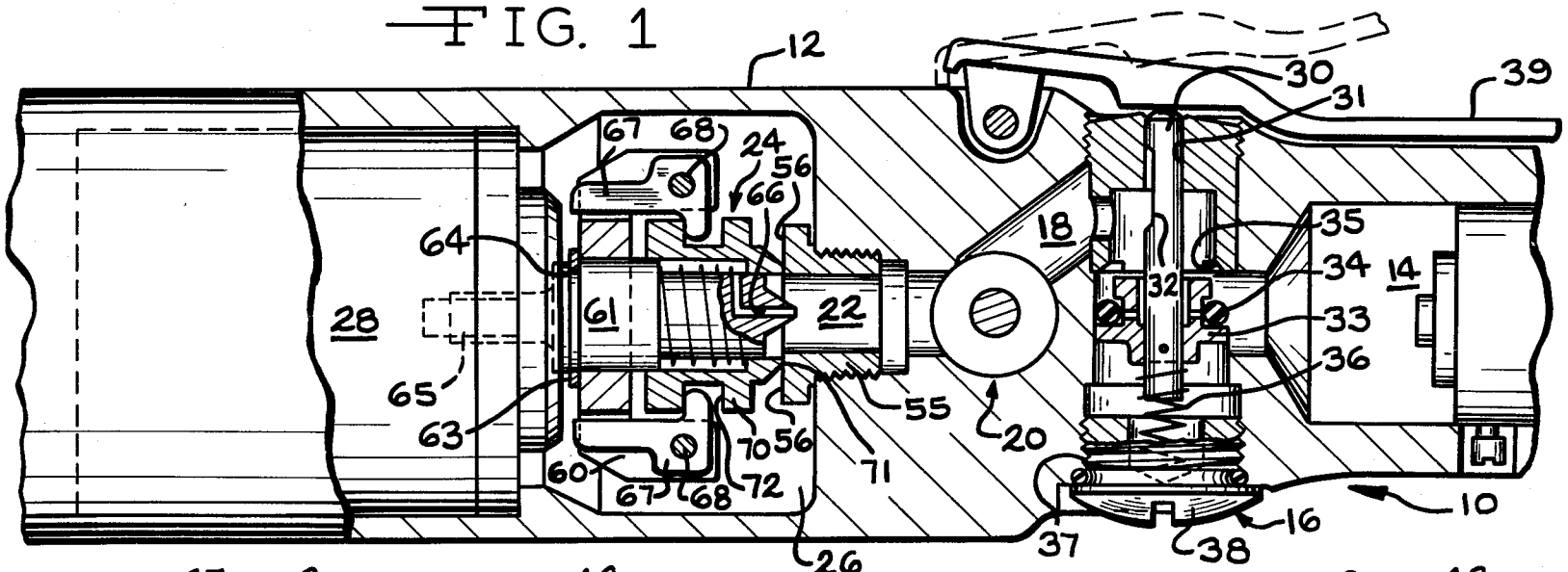
FIG. 1 is a fragmentary, sectional, side elevational view of an air powered tool incorporating the instant invention.

Referring now to FIG. 1, an air powered tool incorporating the instant invention is generally referred to by a reference numeral 10. The tool 10 includes an elongate, generally cylindrical housing 12 which defines an internal air supply passage 14. The air supply passage 14 is in communication with a supply of compressed air (not shown) which is external to the tool 10 and which provides energy to the air powered tool 10 in a conventional fashion. The air supply passage 14 communicates with a control valve assembly 16 which is in turn in communication with a short air passageway 18. The air passageway 18 links the control valve 16 with a shuttle valve assembly 20. The shuttle valve assembly 20 is in turn in communication with an axial air passageway 22 which leads to a speed governor and control valve assembly 24. The speed governor control valve 24 is positioned within a cylindrical cavity 26 which functions as an air passageway leading to the inlet ports (not shown) of an air motor 28.

The control valve assembly 16 includes a generally circular valve stem 30 slidably positioned within a circular opening 31. The valve stem 30 defines a longitudinal reentrant portion or notch 32, the purpose of which will be described subsequently. The control valve assembly 16 further includes a valve plug member 33 having an O-ring or similar seal 34 which seals against a complementary valve seat 35. Disposed concentrically about the valve stem 30 is a compression spring 36 which biases the member 33 and the O-ring 34 against the valve seat 35. Access to the components of the control valve 16 just described may be gained through a threaded access plug 37 having a slotted heat 38. The control valve assembly 16 further includes a control lever 39 which is pivotally secured to the housing 12 by means of a conventional pivot pin. The control lever 39 is disposed in radial alignment with the valve stem 30 and when depressed by the operator of the tool 10 opens the valve defined by the member 33, the O-ring 34 and the seat 35 and allows compressed air into the air passageway 18. Due to the bias of the compression spring 36, when the lever 39 is released, the O-ring 34 and member 33 seat against the valve seat 35 and the flow of compressed air is terminated.

Figure 2:
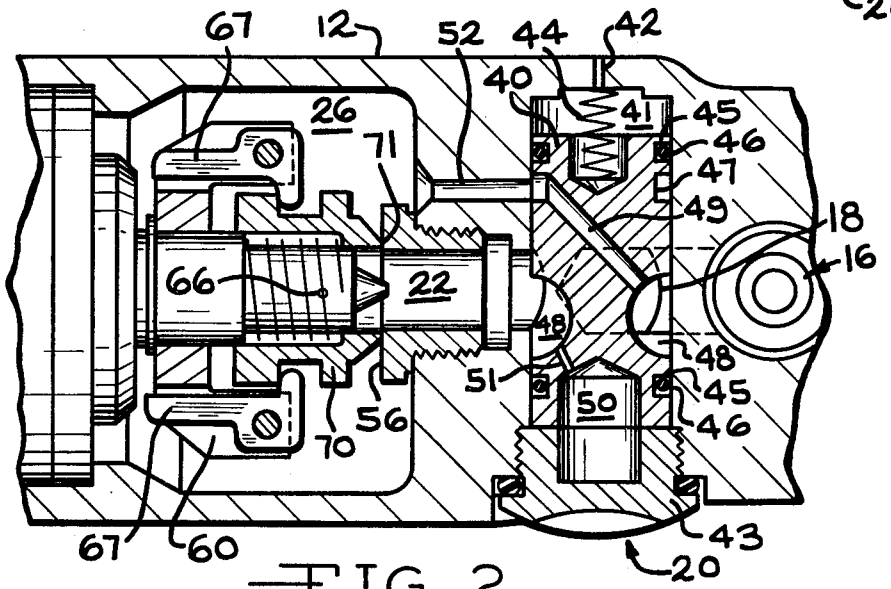
FIG. 2 is a fragmentary, sectional, top plan view of an air powered tool incorporating the instant invention which is not operating.

Referring now to FIG. 2, the air passageway 18 links the control valve assembly 16 with the shuttle valve assembly 20. The shuttle valve assembly 20 comprises a preferably cylindrical shuttle body 40 slidably disposed within a shuttle cavity 41. One end of the shuttle cavity 41 is vented to the atmosphere through the vent port 42 and the opposite end of the cavity 41 is sealed by a threaded plug 43. A compression spring 44 is coaxially disposed in the shuttle cavity 41 between the shuttle body 40 and the housing 12 and biases the shuttle body 40 away from the vent port 42. The outer cylindrical surface of the shuttle body 40 defines four circumferential channels. Two circumferential channels 45, one adjacent each end of the shuttle body 40, each retains an O-ring seal member 46. The shuttle body 40 further defines a circumferential channel 47 near its end most proximate the compression spring 44. The shuttle body 40 also defines a fourth circumferential channel 48 disposed approximately at its axial midpoint. An oblique air passageway 49 links the circumferential channel 47 with the channel 48. The end of the shuttle body 40 opposite the compression spring 44 defines a pressure chamber 50 which is linked to the channel 48 by a passageway 51.

As has previously been noted, the housing 12 also defines an axial air passageway 22 leading from the shuttle valve assembly 20 and specifically the channel 48 of the shuttle body 40 to the speed governor cavity 26. The housing 12 further defines a smaller, axial passageway 52 which communicates between the governor cavity 26 and the circumferential channel 47 of the shuttle body 40 when the shuttle body 40 is in the position illustrated in FIG. 2. The axial passageway 22 is preferably defined by a removable threaded collar 55 which defines a valve seat 56 on its radial face. The utilization of the threaded collar 55 facilitates repair and adjustment of the tool 10 inasmuch as wear or damage to the valve seat 56 may be cured by simply replacing the threaded collar 55.

Figure 9:
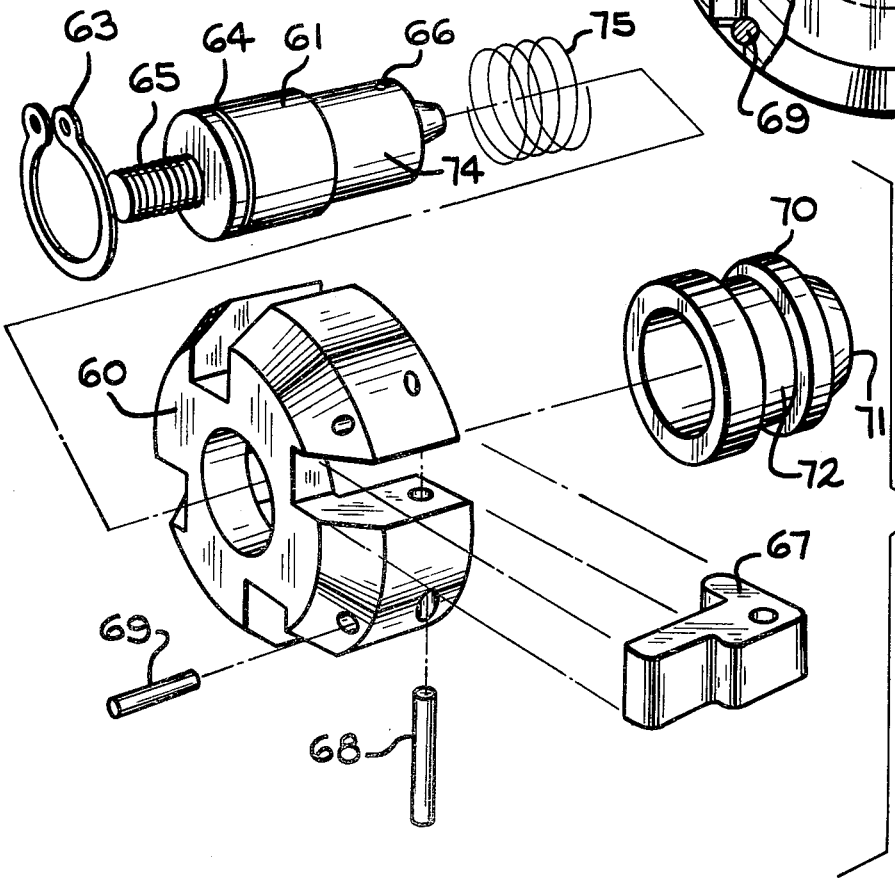
FIG. 9 is an exploded perspective view of a counterweight and governor assembly according to the instant invention.

Referring now to FIGS. 1 and 9, the speed governor and control valve assembly 24 includes a yoke 60 concentrically disposed about and secured to a shaft extension 61. A retainer ring 63 seated in a circumferential channel 64 on the shaft extension 61 limits axial travel of the yoke 60 relative to the shaft extension 61. The shaft extension 61 also includes a threaded stub 65 which mates with complementary threads in a shaft of the air motor 28. The body of the shaft extension 60 further defines an L-shaped passageway 66, the function of which will be described subsequently. The speed governor and control valve assembly 24 thus rotates with the drive shaft of the air motor 28. The speed governor and control valve assembly 24 further includes a plurality of centrifugal weights 67 which are pivotally secured to the yoke 60 by means of a like plurality of pivot pins 68. The pivot pins 68 are in turn retained in the yoke 60 by a like plurality of longitudinally disposed retaining pins 69. Disposed concentrically about the shaft extension 61 is a cylindrical main valve collar 70. The main valve collar 70 defines a concentric valve face 71 which seats against the valve seat 56 of the threaded collar 55. The main valve collar 70 further includes a circumferential channel 72 within which inwardly directed arms of the centrifugal weights 67 are positioned. Disposed concentrically about a reduced diameter portion 75 of the extension 61 and within the valve collar 70 is a compression spring 75. The compression spring 75 biases the main valve collar 70 toward the the threaded collar 55 and valve seat 56 and urges the centrifugal weights 67 to their retracted position as illustrated in FIG. 1.

Referring now to FIG. 6, the theory of operation of a conventional speed governor and the offset weight speed control of the instant invention will be described. In a conventional governor, weights having pivot axes disposed perpendicularly to radial lines passing through the centers of the weights are rotated with a motor, etc., and the radial acceleration resulting from this rotation generates centrifugal forces which operate upon a mechanism which in turn controls the speed of the motor. The centrifugal force is equal to $MR\omega^2$ where M equals the mass of the weight, R equals the radius and $\omega$ equals the angular velocity. Such a weight and governor assembly is responsive only to its instantaneous rotational speed as is apparent from the presence of only an angular velocity variable ($\omega$) in the equation. Such a mounting is schematically illustrated as position A of FIG. 5 wherein the weight 67A is disposed on its pivot 68A perpendicular to a radial line passing through the center of the weight 67A.

By contrast, a weight 67B in position B illustrated in FIG. 6 is responsive only to the positive or negative rate of change of speed of a device, i.e., the acceleration or deceleration. Here the position of the pivot 68B has been translated 90° from the pivot 68A while the axis of the pivot has remained in the same orientation. Thus the pivot 68B is now coaxial with a radial line passing through its center. So positioned, the weight 67A is no longer sensitive to angular velocity inasmuch as the line of action of the centrifugal force resulting therefrom is coaxial with the axis of the pivot 68B. Rather, the weight 67B is sensitive to the rate of change of speed of the device (i.e., the tangential acceleration) and produces a force equal to $MR\alpha$ where M equals the mass of the weight, R equals the radius and $\alpha$ equals the instantaneous angular acceleration (or deceleration). It is apparent from the equation that no sensitivity to instantaneous rotational speed will be exhibited inasmuch as only the variable $\alpha$ appears therein.

The instant invention comprehends a governor or speed control which is responsive to both instantaneous speed and rate of change of that speed. Mechanically, this entails placement of the weight 67C in position C as illustrated in FIG. 6. Here, the weight 67C is displaced from position A where the axis of pivot pin 68A is perpendicular to a radial line passing through its center to position C where the axis of the pivot 68C is at an acute angle $\theta$ to a radial line passing through its center. The weight 67C is thus responsive to both radial acceleration according to the relationship $MRw^2$ sine $\theta$ and tangential acceleration according to the relationship $MR\alpha$ cosine $\theta$. By way of confirmation, at position A, where $\theta=90°$, the sine of 90° is 1 and the equation for force related to radial acceleration reduces to $MR^2$ whereas the cosine of 90° is 0 and the equation for force related to tangential acceleration reduces to 0, both in agreement with previous statements. Analogous results are achieved when $\theta=0°$.

The choice of the value of the angle $\theta$ is primarily empirical and may be selected to produce the desired governor response to the variables of speed and acceleration. The foregoing relationships are also of assistance in determining the angle of displacement $\theta$. For general purpose assembly tools of the type described herein, an angle of 70° has been found satisfactory.

In addition to the purely empirical selection of the angle $\theta$, a second consideration regarding its choice involves the algebraically additive nature of the forces generated by the weights 67 in response to radial and tangential acceleration. The forces associated with radial acceleration (i.e., centrifugal forces) are, of course, always positive. It should be noted, however, that the forces associated with tangential acceleration may be either additive or subtractive relative to the radial forces depending both upon the selection of the angle $\theta$ and whether the assembly 24 is accelerating or decelerating.

Figure 7:
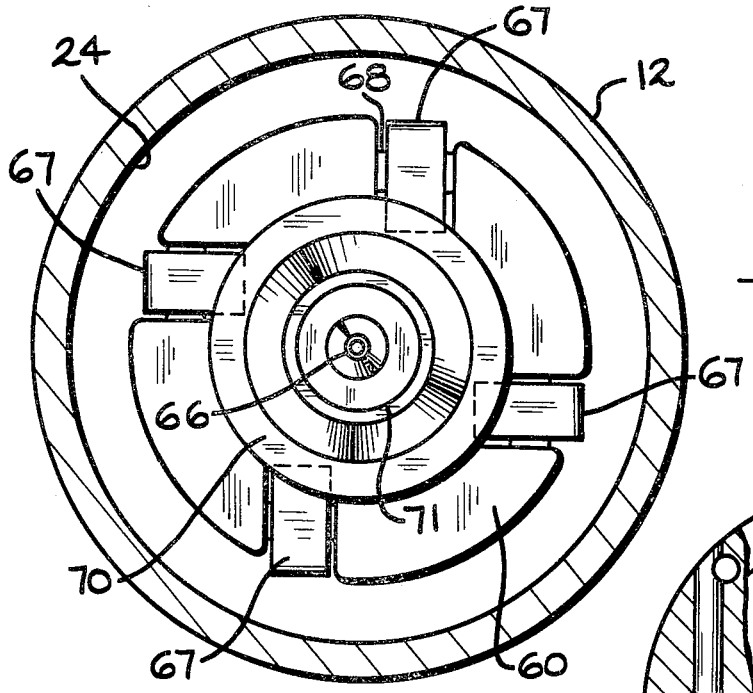
FIG. 7 is a full sectional, end elevational view of an air powered tool incorporating the instant invention taken along line 7—7 of FIG. 1.
Figure 8:
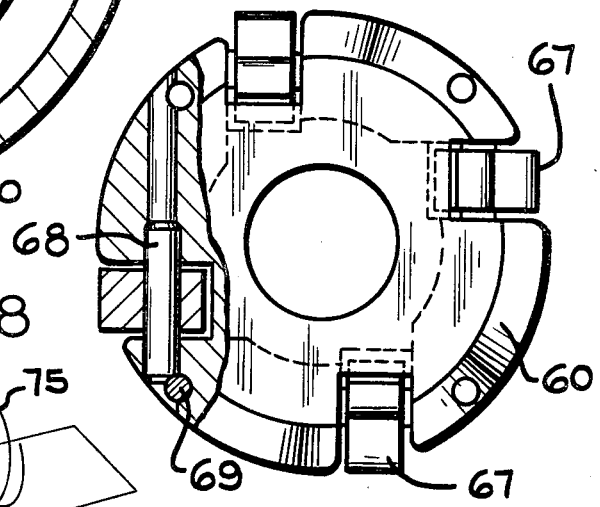
FIG. 8 is a fragmentary, sectional, end elevational view of a counterweight assembly according to the instant invention.

FIG. 7 illustrates the tool 10 viewed from the right (rear) at section line 7—7 of FIG. 1. The motor 28 drives the speed governor and control valve assembly 24 in the clockwise direction. With $\theta$ between 90° and 0°, an increase in speed of the assembly 24, which will first be sensed as tangential acceleration, will sum with the always positive radial acceleration components. The assembly 24 will thus anticipate a higher speed by sensing the rate of increase in speed attendant therewith and initiating corrective action. Likewise, in this location the weight will sense deceleration and subtract this force from the always positive radial acceleration components—again anticipating a slowing of the device so that corrective action may be initiated.

By contrast, the selection of $\theta$ between 90° and 180° will result in a governor assembly wherein the forces associated with tangential deceleration (accompanying a speed decrease) sum with the always positive forces associated with radial acceleration resulting from the instantaneous speed. Analogously, the forces associated with tangential acceleration (accompanying a speed increase) subtract from the always positive radial acceleration forces resulting from the instantaneous speed.

The selection of additive or subtractive tangential acceleration/deceleration related forces with the forces associated with the radial acceleration is, of course, application determined. In the tool 10, disclosed herein, the shutoff governor and control valve assembly 24 is utilized to sense the speed decrease, anticipate the eventual stall and terminate the flow of air to the motor 28. For such an application, a value of $\theta$ equal to 70° has been found satisfactory. It has been determined that in applications having extremely rapid increases in torque requirements and corresponding rapid decrease in motor speed, the tangential decelerative component will be much greater than the radial accelerative component. An angle of $\theta$ somewhat greater than 70° may thus be preferable in such applications. Other values of $\theta$ will provide differently weighted combinations of radial and tangential acceleration sensitivity according to the above stated equations. The instant invention thus comprehends a governor assembly 24 having an infinite range of radial and tangential acceleration component combinations useful in diverse applications.

Referring now to FIGS. 1 and 2, the operation of the tool 10 in general and the control valve assembly 16, the shuttle valve assembly 20 and the shutoff generator and control valve assembly 24, specifically, will be described. As previously noted, compressed air is supplied to the tool 10 through external means and is present in the chamber 14. The operator depresses the tool handle 39 which in turn depresses the valve stem 30 and opens a control valve defined by the valve plug member 33, the O-ring 34 and the valve seat 35. Compressed air thus travels through the passageway 18 to the shuttle valve assembly 20.

Referring now to FIG. 2, it should be apparent that the shutoff governor and control valve assembly 24 is closed since the valve face 71 and valve seat 56 are adjacent. Flow or pressurized air through the axial air passageway 22 is therefore inhibited and it will remain so until the shutoff governor and control valve assembly 24 attains sufficient speed to cause the weights 67 to open the valve assembly 24. The oblique passageway 49 in the shuttle body 40 of the shuttle valve assembly 20 links the air passageway 18 with the bypass passageway 52 during startup of the air motor 28. A sufficient quantity of compressed air may move through the passageways 49 and 52 to start the motor 28 and quickly bring it to about 5,000 r.p.m. or more. At this time, the output spindle (not shown) of the tool 10 is engaged to a fastener and will rapidly run down the fastener at a relatively low torque level.

Figure 3:
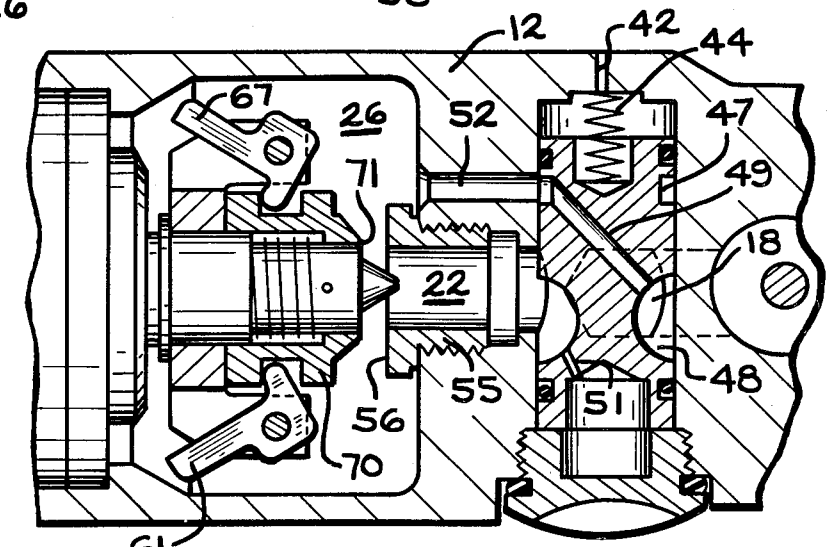
FIG. 3 is a fragmentary, sectional, top plan view of an air powered tool incorporating the instant invention during startup.

Referring now to FIG. 3, the motor 28 has achieved sufficient speed to cause the weights 67 to produce sufficient force to overcome the bias of the compression spring 75, to move outwardly and to draw the main valve collar 70 and the valve face 71 away from the valve seat 56 on the threaded collar 55. The motion of the main valve collar 70 thus opens the axial passageway 22 and allows an increased flow of compressed air from the passageway 18, through the channel 48 in the shuttle body 40, through the axial air passageway 22 and into the cavity 26. The motor 28 is thus now capable of providing full torque output inasmuch as it now receives the maximum quantity and pressure of compressed air.

Referring now to FIG. 4, the next phase of operation of the tool 10 is illustrated. During the previous two phases of startup illustrated in FIGS. 2 and 3, the pressure in the passageways 18 and 22 as well as the circumferential channel 48 has steadily increased. As previously noted, the oblique passageway 51 links the channel 48 with the chamber 50 in the end of the shuttle body 40. The pressure in the chamber 50 thus also increases but at a rate determined by the diameter of the oblique passageway 51. The pressure increase in the chamber 50 moves the shuttle body 40 to the position illustrated in FIG. 4. The speed with which the shuttle body 40 moves between the position illustrated in FIG. 3 and FIG. 4 may also be adjusted by varying the spring constant of the spring 44 and the diameter of the vent port 42. When the shuttle body 40 achieves the position illustrated in FIG. 4, the flow of air between the oblique passageway 49 and the axial passageway 52 is terminated. Therefore, the air motor 28 is driven solely by the air supplied through the passageway 18, the channel 48 in the shuttle body 40 and the axial air passageway 22. During this part of the cycle of operation, the fastener will be run down further and the speed of the motor 28 will be at or near its maximum.

As the fastener approaches the end of its travel and the torque required to tighten it down and complete the fastener operation increases, the speed of the motor 28 will slow and the total force produced by the centrifugal weights 67 due to the radial and tangential acceleration of the shutoff governor and control valve assembly 24 will decrease. The instantaneous total force will be the algebraic summation of the always positive radial accelerative forces associated with the instantaneous speed and the negative and thus subtractive tangential decelerative force associated with the decreasing speed. As this total force decreases in magnitude, the axial force of the compression spring 75 will eventually overcome it and the main valve collar 70 will move longitudinally towards the valve seat 56 and decrease the supply of air through the axial passageway 22.

Referring now to FIG. 5, as the speed of the motor 28 slows to between 100 and 1,000 r.p.m. and the rate of deceleration increases, the valve face 71 will begin to close against the valve seat 56. As the motor 28 slows further and the valve collar 70 and valve face 71 close against the valve seat 56, unstable operation and uneven torque application can result due to the transient nature of the shutoff phase of operation. Positive close off of the control valve assembly 24 and consistant ultimate torque level is assured by the incorporation of the air port 66 in the shaft extension 61. As closure of the valve assembly 24 becomes imminent, pressurized air from the axial passageway 22 is transmitted to the chamber defined by the reduced diameter 74 of the shaft extension 61 and the inner surface of the main valve collar 70. Thus, as the main valve collar 70 advances toward the valve seat 56, the axial end of the air port 66 receives compressed air from the axial passageway 22, supplies it to the chamber and the valve assembly 24 is snapped closed. At this time, the fastener is properly torqued down and until the lever 39 is released by the by the operator, no further mechanical activity within the tool 10 will occur.

When the lever 39 is released by the operator (the released position of the lever being shown by the dashed lines in FIG. 1) the control valve assembly 16 will close and terminate the passage of compressed air from the air supply passage 14 into the passageway 18 and additional components of the tool 10. As the circular valve stem 30 follows the released lever 39 and closes the control valve assembly 16, the notch 32 disposed longitudinally along one edge opens an exit passageway from the air passageway 18 to the atmosphere. The passageway formed by the notch 32 thus exhausts the passageway 18 and the passageways in communication therewith, namely, channel 48, axial air passageway 22 and the oblique passageway 51 leading to the air chamber 50. Depressurization of the air chamber 50 causes the compression spring 44 to advance the shuttle body 40 from the position illustrated in FIG. 5 to the startup position illustrated in FIG. 2. Again, the speed of the depressurization of the air chamber 50 is dependent upon the diameter of the oblique passageway 51 and the overall speed with which the shuttle body 40 returns to the startup position is determined not only by the diameter of the oblique passageway 51 but also the spring constant of the spring 44 and the diameter of the vent port 42. When the shuttle body 40 returns to the position illustrated in FIG. 2 and realigns the channel 47 with the bypass air passageway 52, the tool 10 is again ready for operation.

The foregoing disclosure is the best mode devised by the inventor for practicing this invention. It is apparent, however, that methods incorporating modifications and variations to the instant invention will be obvious to one skilled in the art of pneumatic tools. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What I claim is:

1. A speed responsive air shutoff mechanism for a pneumatic rotary tool having a throttle valve and an air motor comprising, in combination, a main air valve operably disposed between said throttle valve and said air motor and means interconnected with said main valve for opening said main valve in response to a predetermined level of instantaneous speed and acceleration and for closing said main valve in response to a predetermined lower level of instantaneous speed and deceleration.

2. The speed responsive air shutoff mechanism of claim 1, further including means for biasing said main valve toward a closed position.

3. The speed responsive air shutoff mechanism of claim 1, wherein said means for opening and closing said main valve includes a plurality of pivoted flyweights disposed about a central axis having pivot axes disposed at an acute angle relative to a radial line extending from said central axis.

4. The speed responsive air shutoff mechanism of claim 3, wherein said acute angle is approximately 70°.

5. A speed sensitive shutoff for a rotary air tool having an air motor operable by a throttle valve with an air passage therebetween, comprising, in combination, a main air valve in said air passage between the air motor and the throttle valve including means for biasing said main valve toward a closed position to close off said air passage, means responsive to both instantaneous speed and rate of change of speed for opening and closing said main valve and a normally open valve disposed in parallel with said main air valve and effective to bypass air around said main air valve.

6. The speed sensitive shutoff of claim 5, wherein said means responsive to both instantaneous speed and rate of change of speed comprises at least two pivoted flyweights disposed in a yoke having a central axis, said flyweights having axes of pivot disposed at an angle greater than 0° but less than 90° relative to a radial line extending from said central axis.

7. The speed responsive air shutoff mechanism of claim 5, wherein said acute angle is approximately 70°.

8. The speed sensitive shutoff for the rotary air tool of claim 5, further including means for closing and maintaining closure of said normally open valve during operation of the tool after said main valve has opened and until the throttle valve is closed.

9. A speed responsive air shutoff mechanism for a pneumatic tool having a throttle valve, a main valve and an air motor serially connected by air passageways comprising, in combination, flyweight governor means interconnected with said main valve having a plurality of pivoted flyweights disposed about a central axis and having pivot axes disposed at an acute angle relative to a radial line from said central axis for opening said main valve in response to a predetermined level of instantaneous speed and acceleration and for closing said main valve in response to a predetermined lower level of instantaneous speed and deceleration, whereby, while the throttle valve is open, air is supplied to said air motor until the instantaneous speed and deceleration achieves said lower level whereupon said air flow is terminated.

10. The speed responsive air shutoff mechanism of claim 9, wherein said acute angle is approximately 70°.

* * * * *